US007836549B1

(12) United States Patent
McGuigan

(10) Patent No.: US 7,836,549 B1
(45) Date of Patent: Nov. 23, 2010

(54) MULTI-DIRECTIONAL HINGE

(75) Inventor: Thomas E. McGuigan, Neptune City, NJ (US)

(73) Assignee: Lockhead Martin Corporation, Bethesda, MD (US)

( * ) Notice: Subject to any disclaimer, the term of this patent is extended or adjusted under 35 U.S.C. 154(b) by 711 days.

(21) Appl. No.: 11/708,933

(22) Filed: Feb. 20, 2007

(51) Int. Cl.
*E05D 7/10* (2006.01)

(52) U.S. Cl. ..... 16/266; 16/361; 16/362

(58) Field of Classification Search ..... 16/266, 16/267, 362, 361, 239; 49/252, 399, 400, 49/423, 424; 211/13.1, 26.2, 27, 126.15, 211/128.1, 129.1, 131.2, 132.1; 312/223.1, 312/223.2, 290, 220; 220/836, 835, 841, 220/845

See application file for complete search history.

(56) References Cited

U.S. PATENT DOCUMENTS

| | | | | | |
|---|---|---|---|---|---|
| 1,335,999 | A * | 4/1920 | Stover | ..... | 16/361 |
| 1,477,953 | A * | 12/1923 | Hays | ..... | 16/267 |
| 1,602,754 | A * | 10/1926 | Delbridge | ..... | 16/266 |
| 3,333,726 | A * | 8/1967 | Belanger | ..... | 220/836 |
| 4,257,388 | A | 3/1981 | McGuire | | |
| 4,258,967 | A * | 3/1981 | Boudreau | ..... | 312/322 |
| 4,701,977 | A * | 10/1987 | Hori et al. | ..... | 16/266 |
| 4,841,601 | A * | 6/1989 | Taima | ..... | 16/361 |
| 5,121,824 | A * | 6/1992 | Halsey et al. | ..... | 194/350 |
| 5,193,308 | A | 3/1993 | Davidian | | |
| 5,216,839 | A | 6/1993 | Woodruff | | |
| 5,257,846 | A * | 11/1993 | Kanai et al. | ..... | 296/37.14 |
| 6,330,161 | B1 * | 12/2001 | Smith et al. | ..... | 361/724 |
| 7,508,338 | B2 | 3/2009 | Pluymers et al. | | |
| 2003/0137804 | A1 * | 7/2003 | Chen et al. | ..... | 361/683 |

* cited by examiner

*Primary Examiner*—Chuck Y. Mah
(74) *Attorney, Agent, or Firm*—Duane Morris LLP

(57) ABSTRACT

A hinge providing multi-directional motion to a hinged object. In one embodiment, the hinge includes a first hinge member having at least one first outwardly-protruding mounting projection and a second hinge member defining a recess for movably receiving the projection. In one embodiment, the recess and mounting projection are complementary configured for non-rotational linear movement of the projection in a first portion of the recess, and for rotational movement of the projection in a second portion of the recess. A preferred embodiment includes a pair of spaced-apart recesses and projections. The hinged object may be squarely slid into engagement with a supporting unit or frame via the first portion of the recess, yet rotated or pivoted via the second portion to provide access to the supporting unit. The supporting unit or frame in one embodiment may be part of a module in an active antenna array.

15 Claims, 6 Drawing Sheets

MULTI-DIRECTIONAL HINGE

FIELD OF INVENTION

The present invention generally relates to antenna arrays, and more particularly to an improved array packaging architecture and hinge system for mounting array components.

BACKGROUND OF THE INVENTION

Active antenna arrays have the potential to improve and expand capability, reliability, and reduce life cycle costs for radar and communication systems. The primary components in these arrays are generally microwave multi-chip modules incorporating monolithic microwave integrated circuits (MMICs), associated power supply and conditioning components to drive these modules, signal processors, and distributed receiver/exciter (DREX) components. These components are typically packaged together in various individual assemblies known as Line Replaceable Units (LRUs) in the art for ease of maintenance and replacement. Furthermore, packaging the foregoing components together and distributed them throughout the array yields cost and performance advantages over more traditional "off-array" designs that alternatively locate some of these components in a central location.

Because the foregoing array components generate a significant amount of heat, the components have historically been attached directly to liquid-cooled coldplates to absorb and dissipate the heat, thereby cooling the array. The need to place these array components in direct contact with coldplates, however, has resulted in constraints on packaging of these components together into a compact space within a module. Moreover, the size of each microwave module is directly correlated to and further constrained by the size of the coldplate radiating element lattice size which is based on cooling performance requirements. Accordingly, there is a need for an improved and compact array component packaging architecture that adequately cools the components, yet maintains accessibility to the components for maintenance and replacement.

SUMMARY OF INVENTION

An improved array packaging architecture and hinge system is provided that allows a compact array and microwave module design to be utilized while providing access to the various module components. In one embodiment, the module includes placement of one electrically active electronic component such as an LRU on the rear or back of the module. A unique multi-directional hinge according to principles of the present invention provides both rotational motion and linear motion for the rear LRU or other electronic component. The hinge advantageously allows the rear LRU to be readily pivoted out of the way or entirely removed from the array to gain access to other LRUs or components in the module for maintenance or replacement. The hinge also advantageously provides linear motion for the rear LRU for making the electrical connections between the LRU and other microwave module components to prevent damaging the electrical connectors.

In one embodiment, a multi-directional hinge according to principles of the present invention includes a first hinge member having at least one first outwardly-protruding mounting projection having an elongated cross-section, and a second hinge member having a recess defining a horizontal axis and a vertical axis, the projection movably received in the recess, the recess and mounting projection complementary configured for: (i) non-rotational horizontal axial or linear movement of the projection in a first portion of the recess; and (ii) rotational movement of the projection in a second portion of the recess. In some embodiments, the second portion of the recess may include a removal opening or slot through which the projection is slideably removable from the recess. This allows the first hinge member to be completely disengaged from the second hinge member for removal. In some embodiments, the first portion of the recess is an elongated slot having a height and width; the height being less than the width. The second portion of the recess may be an enlarged receptacle in one embodiment. The receptacle has a height and width, and in some embodiments the height may be at least equal to or greater than the width to allow rotation of the projection in the receptacle and Concomitantly the first member.

In one embodiment, the second hinge member may be a bracket supported by a frame with the recess formed in the bracket. In other embodiments, the hinge may include a pair of spaced-apart brackets each having a recess. Accordingly, a second mounting projection may be provided on the first hinge member and spaced apart from the first mounting projection so that the first and second mounting projections each movably engage the recess of one of the space-apart brackets. In a preferred embodiment, the first hinge member may be a movable equipment access cover, and more preferably an electrically active electronic component such as an LRU having at least one electrical connection.

A multi-directional hinge in another embodiment according to principles of the present invention includes a first member defining at least one first outwardly-projecting hinge tab, the tab preferably having a width and a height wherein the width is greater than the height, and a second member having a first recess receiving the first hinge tab of the first member. The recess in a preferred embodiment includes a slot complimentary configured with the tab to allow non-rotational linear movement of the tab in the slot and an enlarged receptacle complimentary configured with the tab to allow rotational movement of the tab in the receptacle. The first hinge tab is movable from a first position in the slot where the tab cannot be rotated with respect to the slot to a second position in the receptacle where the tab can be rotated with respect to the receptacle. The receptacle in one embodiment preferably has a height and a width that are each at least slightly larger than the width of the first hinge tab to allow rotational movement of the tab in the receptacle. In one embodiment, the slot preferably has a height that is only slightly larger than the height of the first hinge tab which is sufficient to slide the tab in the slot but prevent rotation of the tab in the slot.

In another embodiment, the first hinge member includes a second hinge tab laterally spaced apart from the first hinge tab; the second hinge tab having a width and a height wherein the width is greater than the height. Preferably, a third hinge member is also provided that has a second recess receiving the second hinge tab therein and being laterally spaced apart from the first recess. Similarly to the first recess, the second recess, preferably is essentially identical to the first recess and includes a slot complimentary configured with the second hinge tab to allow non-rotational linear movement of the second tab in the slot and an enlarged receptacle complimentary configured with the second tab to allow rotational movement of the second tab in the receptacle. In some embodiments, the first hinge member further includes a guide tab spaced-vertically apart from the first and second hinge tabs. The guide tab in one embodiment is received in a channel disposed on a frame supporting the second and third hinge members.

In some embodiments, the second hinge member may be a bracket preferably supported by and projecting outwards from a frame, and more preferably projecting from the rear of the frame. The first hinge member in one embodiment includes a guide tab spaced-vertically apart from the first hinge tab and received in a channel disposed on the rear of the frame. The guide tab is axially or linearly slideable in the channel. In some embodiments, a plurality of brackets containing both recesses and channels may be provided for mounting a plurality of first hinge members to the frame. In a preferred embodiment, the first hinge member is a movable equipment access cover, and more preferably in other embodiments the access cover is an electrically active electronic component have at least one electrical connection such as an LRU.

In another embodiment, a hinge according to principles of the present invention includes a unit including a pair of laterally spaced apart elongated hinge tabs, each tab projecting outwards from the unit and having a width larger than a height, and a frame supporting the unit and including a pair of spaced-apart brackets each having a recess receiving one of the tabs respectively therein. Each recess in one embodiment preferably includes an elongated horizontal slot configured for non-rotational linear movement of the respective tab therein, a vertical slot, and an enlarged receptacle formed at an intersection of the horizontal and vertical slots, the receptacle sized and configured with the respective tab to allow rotational movement of the tab therein. The unit is pivotally moveable with respect to the frame via rotation of the tab in the receptacle. In some embodiments, the unit further includes a guide tab spaced-vertically apart from the first and second hinge tabs on the unit. The guide tab is received in a channel disposed on the frame in one embodiment. The guide tab may have an elongated shape in some embodiments. In some embodiments, the channel may be provided on a third bracket disposed on the frame. The third bracket may include a recess receiving a third hinge tab from a second unit, the recess comprising an elongated horizontal slot configured for non-rotational linear movement of the third hinge tab therein, a vertical slot, and an enlarged receptacle formed at an intersection of the horizontal and vertical slots, the receptacle sized and configured with the third hinge tab to allow rotational movement of the third tab therein. In some embodiments, the unit may preferably be a electrically active and includes at least one electrical connection, and more preferably may be a line replaceable unit of an antenna array.

In another multi-directional hinge formed according to principles of the present invention the hinge includes a unit having a pair of laterally spaced apart elongated hinge tabs, each hinge tab projecting outwards from the unit and having a width larger than a height, and a frame supporting the unit. In one embodiment, the frame includes a pair of spaced-apart brackets each having a recess receiving one of the hinge tabs respectively therein; each recess preferably including an elongated horizontal slot configured for non-rotational linear movement of the respective tab therein, a removal slot, and an enlarged receptacle formed at an intersection of the horizontal and vertical slots. Preferably, the receptacle is sized and configured with the respective hinge tab received to allow rotational movement of the tab therein. The unit may further include a guide tab spaced-vertically apart from the first and second hinge tabs on the unit. In one embodiment, the guide tab is received in a channel disposed on the frame. The unit is pivotally moveable with respect to the frame via rotation of the tab in the receptacle and completely removable from the frame via the removal slot.

In one embodiment, the removal slot is located vertically with respect to the receptacle. In another embodiment, the horizontal slot is located between the receptacle and frame. In yet another embodiment, each bracket includes a channel configured to receive a guide tab from an adjoining unit.

The hinge disclosed herein provides a mechanically simple design that is cost-effective to manufacture and reliable by virtue of its mechanical simplicity.

BRIEF DESCRIPTION OF THE DRAWINGS

The features of the preferred embodiments will be described with reference to the following drawings where like elements are labeled similarly, and in which.

DETAILED DESCRIPTION OF THE INVENTION

In the description of embodiments of the invention disclosed herein, any reference to direction or orientation is merely intended for convenience of description and is not intended in any way to limit the scope of the present invention. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

Figure 1:
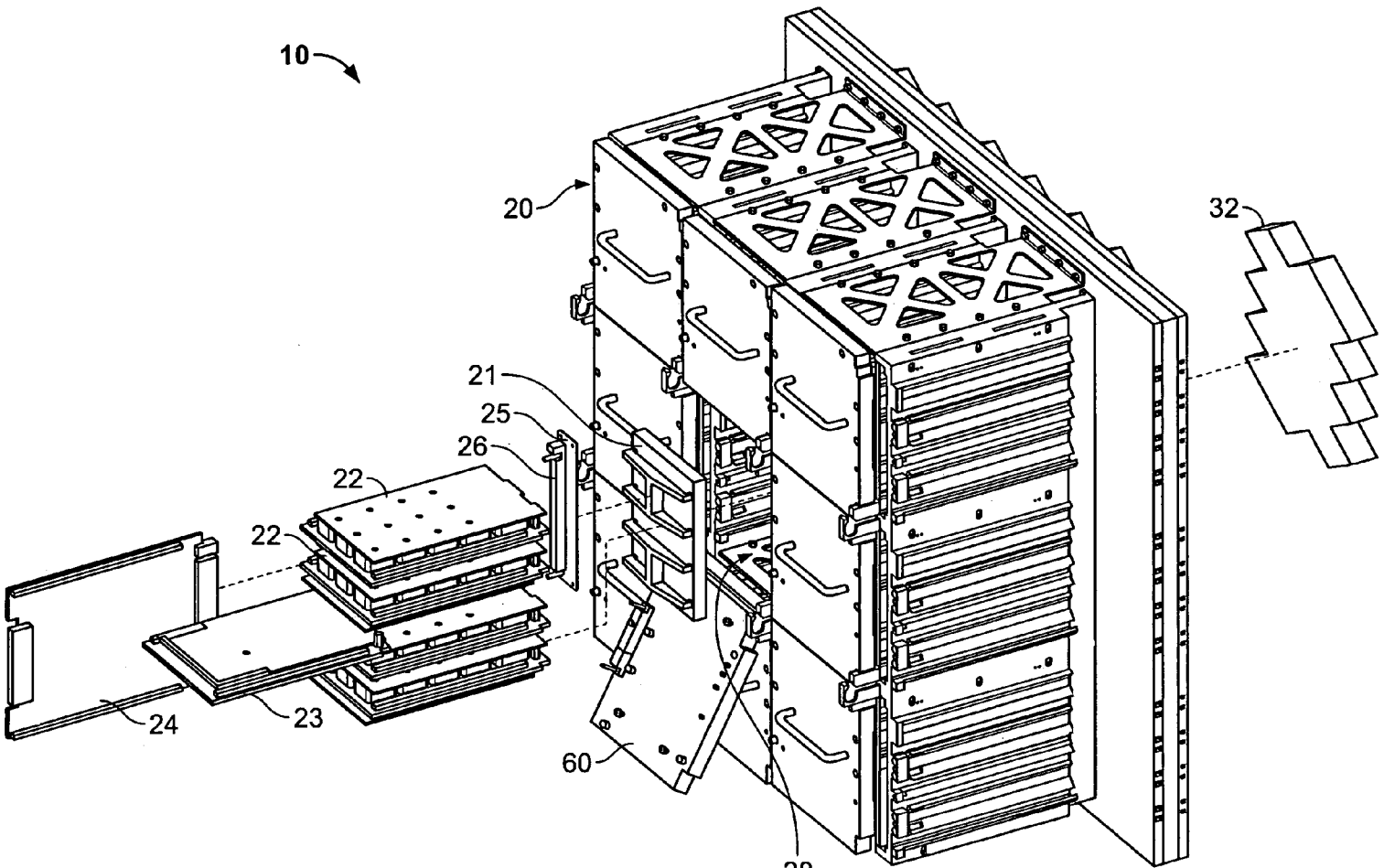
FIG. 1 is a rear perspective view of a preferred embodiment of an antenna array according to the present invention comprised of a plurality of sub-array modules, with an exploded view of one module shown removed from the array.
Figure 2:
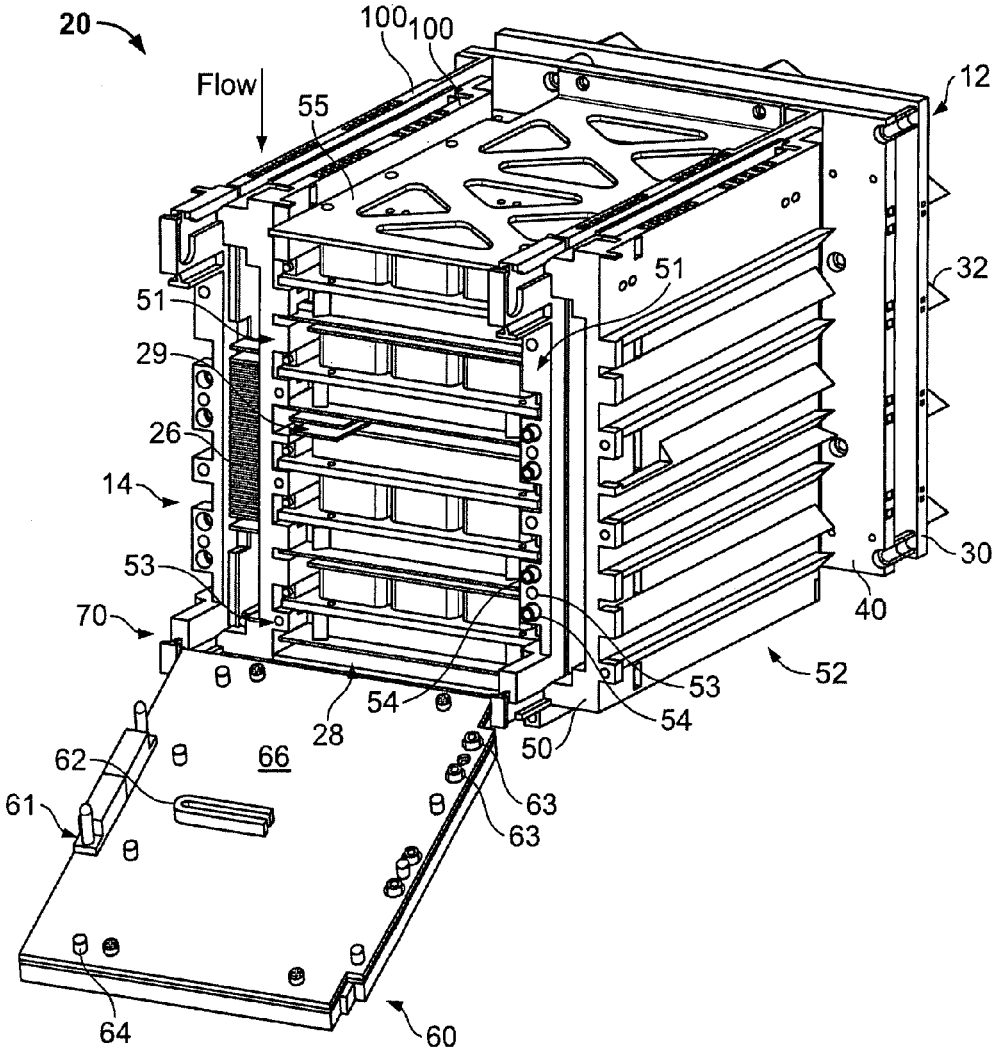
FIG. 2 is a rear perspective view of the module of FIG. 1 with the interior components of the module exposed.
Figure 3:
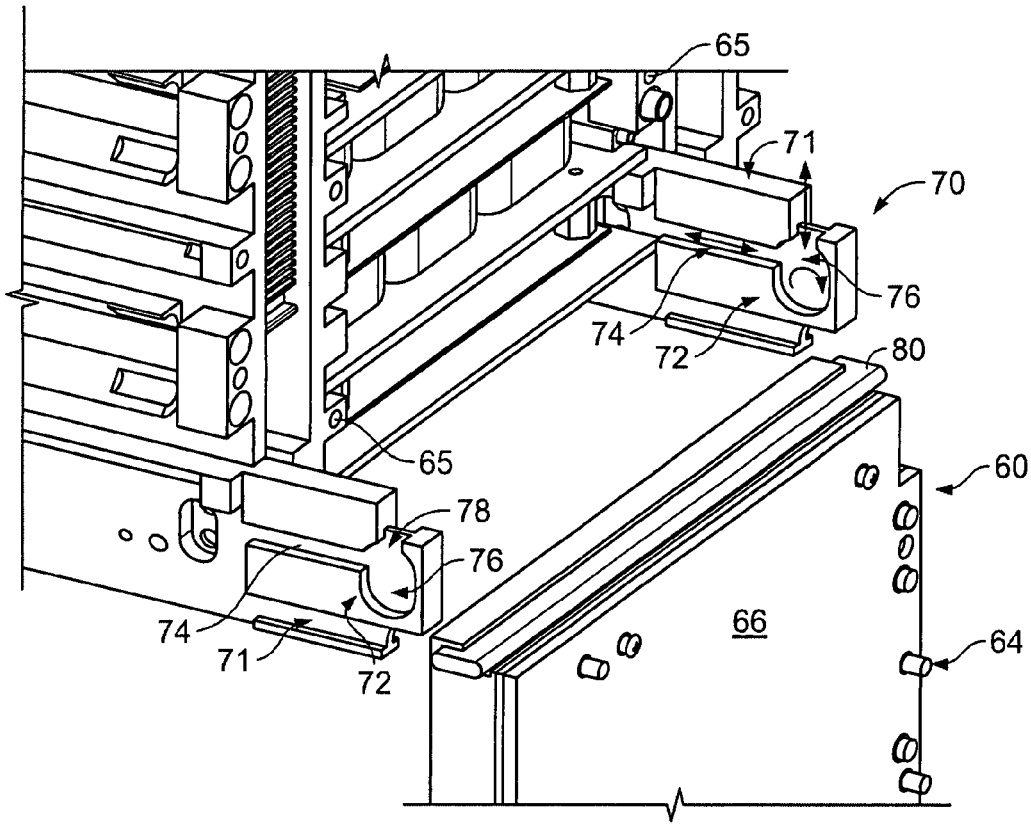
FIG. 3 is a perspective view of a hinge of the module of FIG. 2 with one embodiment of a rear cover formed by a removable rear LRU.
Figure 4:
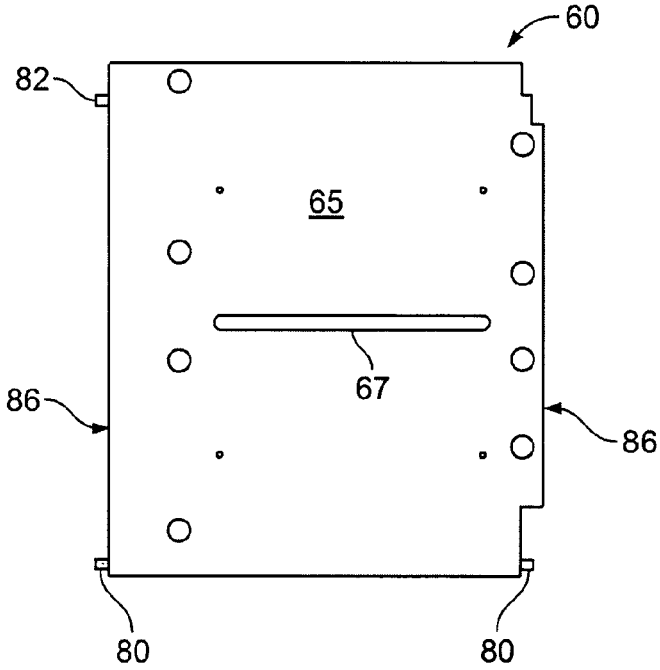
FIG. 4 is a rear exterior elevation view of the removable LRU of FIG. 3.

Referring to FIGS. 1 and 2, one embodiment of an active antenna array and microwave multi-chip sub-array module are shown that may be used as a repeating section in the antenna array. FIG. 1 shows an active antenna array 10 comprised of multiple modules 20 assembled together. In one embodiment as shown, each module 20 may include a transmit T/R LRU 21, transmit power LRU 22, receive power LRU 23, and DREX LRU 60. A Processor LRU 24 is provided which includes a processor backplane 25 with high speed digital connector 26. For convenience of description purposes only, and without limitation, module 20 may be considered to have a front end 12 and a back end 14.

DREX LRU 60 has an exterior face 65 with handle 67 and an interior face 66. Interior face 66 of DREX LRU 60 includes a high speed digital connector 61 configured and adapted to mate with complementary configured digital connector 26 located on processor backplane 25. DREX LRU 60 further includes an input power connector 62 on interior face 66 which is configured and adapted to mate with complementary configured power connector 29 on the back of receive power LRU 23*. RF signal connectors 63 on DREX LRU 60 are provided on interior face 66 to mate with complementary configured RF beamformer connectors 54 on the back end 14 of module 20. A plurality of threaded fasteners 64 are incorporated into DREX LRU 60 assembly that extend from exterior face 65 through interior face 66 as shown to engage threaded sockets 53 on the back end 14 of module 20 to secure the DREX LRU to the module. Fasteners 64 may be operated from the exterior face 65 of DREX LRU 60 to install and remove the DREX LRU from module 20.

In one embodiment, a frame 52 for structurally supporting a plurality of modules 20 may be formed from a combination of liquid-cooled coldplates. In one embodiment, frame 52 includes a first vertical radiator coldplate 30 having heat-dissipating radiating elements 32 projecting outwards therefrom, a second vertical T/R coldplate 40 coupled to coldplate 30 for cooling T/R LRU 21, and two columnar vertical coldplates 50 attached to coldplate 40 and forming sidewalls for module 20. Columnar coldplates 50 are spaced apart to define interior space 26 for housing the various foregoing LRUs 21, 22, 23, 24 and 60, and in the embodiment shown, are oriented generally perpendicular to coldplate 40. In one embodiment as shown, lateral bracing 55 may also be attached between coldplates 40 and 50 to add stability to module 20.

Coldplates 30, 40, 50 function to not only structurally support the various module 20 components, but also act to absorb, transfer, and dissipate heat generated by these various components to cool the antenna array. Columnar coldplates 50 function as heat sinks to absorb heat from and cool DREX LRU 60 and other LRU's inside module 20. In one embodiment as shown in FIG. 2, a liquid coolant (such as water with ethylene glycol, for example) flows vertically through columnar coldplates 50 in passages 100 to remove accumulated heat, as further explained herein.

Although antenna array 10 and coldplates 30, 40, and 50 are shown in a vertical orientation, it will be appreciated these components may be used in any suitable orientation depending on the particular intended application. Accordingly, the invention is not limited to arrays and components aligned in a generally vertical orientation.

According to another aspect of the invention, in order to achieve a compact size for module 20, the preferred array packaging architecture advantageously locates an active LRU, such as DREX LRU 60 in one embodiment, at the back end 14 of the module behind the other components as shown. This arrangement allows DREX LRU 60 to be incorporated into module 20 without increasing the vertical or lateral size of the module since the DREX LRU does not occupy interior space 28 allocated for the other LRUs. This preferred placement of DREX LRU 60, however, requires that unique electrical interfaces and thermal cooling interfaces required for DREX LRU be accommodated, as well as preserving access for maintenance to the other LRUs housed in module 20.

According to another aspect of the invention, therefore, a unique hinge system is provided that provides both restricted linear motion and rotational motion for removably attaching DREX LRU 60 to the back end of module 20. The combined motion advantageously accommodates the linear motion required to securely make the electrical interface connections on the back end 14 of module 20 and the rotational motion necessary to pivot and/or remove DREX LRU 60 from the back end of module 20 to access the other LRUs. As shown in FIGS. 3-5 and 10, hinge 70 in one embodiment preferably includes a slot and tab design including a first hinge member such as recess 72 defined by frame 52. In one embodiment as shown, recess 72 is preferably defined by a protrusion projecting outwards from frame 52 such as hinge bracket 71. Hinge bracket 71 preferably is located on the back end 14 of module 20 and projects rearward in one embodiment. Hinge bracket 71 also preferably has a sufficient length $L_B$ to provide adequate clearance from frame 52 for swinging/pivoting DREX LRU 60 away from Module 20, as further explained herein. Bracket 71 may be a separate component attached to frame 52, and more preferably to columnar coldplate 50 in one embodiment, or the bracket may be formed as an integral part of the frame or coldplate in other embodiments.

Recess 72 is configured and adapted to receive a complementary-configured second hinge member such as bottom hinge mounting projection or tab 80, which in one embodiment extends laterally outwards from the side 86 of DREX LRU 60. In a preferred embodiment, at least two spaced-apart tabs 80 are provided that each engage one of a pair of spaced-apart recesses 72, as shown herein. In some embodiments, at least one top guide projection or tab 82 may also be provided on DREX LRU 60 which is received in an elongated guide channel 92 (see, e.g., FIG. 10) also included with bracket 71. In one embodiment, guide channel 92 is defined by an inverted T-shaped member 90 projecting downwards from bracket 71 to provide a channel accessible from either side of bracket 71. In some embodiments, as shown, guide tab 82 may be elongated or oblong in cross-section. In other embodiments, guide 82 may be circular/round (such as a pin) or have other suitable cross-sectional shapes.

In a preferred embodiment, two bottom hinges 70 are provided on either side of DREX LRU 60. Accordingly, as shown in the accompanying figures, the back of frame 52 preferably includes a plurality of recesses 72 to receive hinge mounting tabs 80 and/or guide tabs 82 from a plurality of DREX LRUs 60 that are associated with multiple modules 20 stacked vertically and laterally adjacent to each other which comprise the antenna array (see, e.g., FIG. 1). In some embodiments, recesses 72 preferably are formed on both sides of bracket 71 for convenience and manufacturing efficiency to accommodate multiple interconnected modules 20 and DREX LRUs 60.

With reference to FIGS. 6-8 and 10, recess 72 defines a horizontal axis H and vertical axis V. In one embodiment, recess 72 includes a first portion including an elongated horizontal connector engagement slot 74 and a second portion including an enlarged receptacle 76. Slot 74 preferably has a width $W_{S1}$ which is larger than its height $H_{S1}$. In some embodiments, receptacle 76 may have a generally circular or oblong configuration as shown. Receptacle 76 defines a pivot axis P for hinge 70 and DREX LRU 60. Receptacle 76 may further include a removal slot or opening 78, which preferably is located to allow tab 80 to be moved vertically upwards in the receptacle 76 thereby allowing DREX LRU 60 to be completely removed from module 20 if desired. In other embodiments contemplated, opening 78 may be located horizontally with respect to receptacle 76 or in other suitable positions.

Preferably, slot 74 is complementary configured and sized with tabs 80 and 82 to provide primarily horizontal linear sliding motion of the tabs in the slot, but to preclude or permit only limited vertical movement or play of the tabs. When the electrical interface connections are made, this keeps DREX LRU 60 in an essentially vertical position perpendicular to the horizontal axis H so that the electrical connectors on the DREX LRU squarely engage their complementary stationary counterpart electrical connectors on the back end 14 of module 20 to prevent damaging the connectors. Slot 74 therefore provides guided linear sliding motion and support for DREX LRU tab 80, with preferably little or no rotational movement of tab 80 in slot 74. Accordingly, in one embodiment, slot 74 has a height $H_{S1}$ and tab 80 has a height $H_T$ which preferably is only slightly less than $H_{S1}$ to limit the tab's vertical and rotational movement in the slot to prevent excessive tilting of DREX LRU 60 when the tab is engaged with the slot (see FIG. 6).

Figure 7:
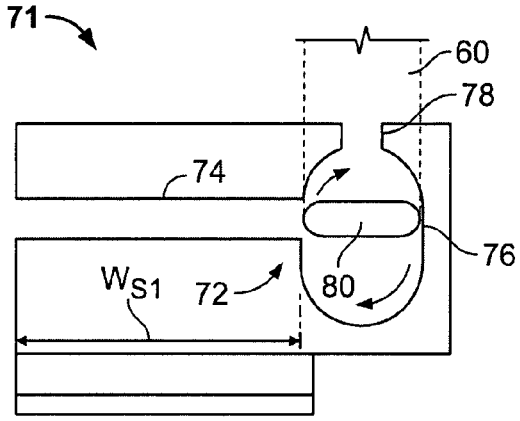
Figure 8:
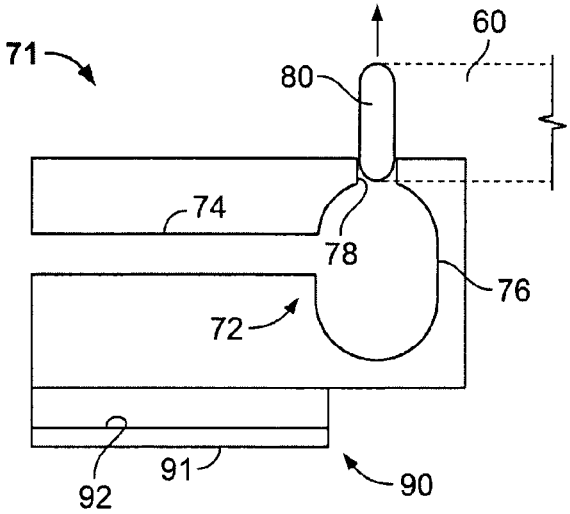

In one embodiment, enlarged receptacle 76 has a width $W_{S2}$ and a height $H_{S2}$ which is slightly larger than width $W_T$ of tab 80 to allow the tab to be rotated within receptacle 76 (see FIG. 7). Similarly, for the same reason, height $H_{S2}$ of receptacle 76 is also preferably larger than height $H_{S1}$ of slot 74. This allows DREX LRU 60 to be swung or pivoted out of the way to gain access to interior space 28 of module 20, or completely removed from module 20 by vertically aligning and sliding tab 80 out through removal slot or opening 78. Accordingly, opening 78 preferably has a width $W_{S3}$ slightly larger than height $H_T$ of tab 80 in one embodiment (see, e.g., FIG. 8). In other embodiments contemplated, opening 78 may have a width $W_{S3}$ larger than width $W_T$ of tab 80 to allow the tab to be moved vertically upwards in receptacle 76 without rotation so that DREX LRU 60 can be lifted upwards and completely removed from module 20 similarly without rotating the DREX LRU. Accordingly, it will be appreciated that numerous configurations and sizes of receptacle 76 and removal slot 78 are possible.

Although hinge tab 80 preferably is elongated or oblong in cross-sectional shape to provide vertical stability to DREX LRU 60 as it is slid into contact with the electrical interface connections on the rear of module 20, it is contemplated that in other embodiments tab 80 may be round/circular (such as a pin) or square in shape, or have other suitable cross-sectional geometric configurations. Accordingly, the invention is not limited to hinge tabs with elongate cross-sectional shapes alone.

It will be noted that DREX LRU 60 acts as a back access cover for module 20 and as a structural member adding support to the module, in addition to being an active component in the antenna array. It will further be noted in the embodiment shown in the figures (see, e.g., FIG. 10), channel 92 formed on the lower portion of hinge bracket 71 is intended to receive a top guide tab 82 from one first DREX LRU 60, while recess 72 formed on the upper portion of hinge bracket 71 receives a bottom hinge tab 80 from a different second DREX LRU 60 located vertically above the first DREX LRU. In other embodiments contemplated, channel 92 may be formed on a component or on frame 52 separately from hinge bracket 71.

The back or rear of columnar coldplates 50 include a plurality of thermal interface surfaces 51 which abut interior face 66 of DREX LRU 60 when the DREX LRU is mounted and secured to the back end 14 of module 20. The abutting surfaces/faces 51, 66 conduct heat away from DREX LRU 60 to columnar coldplates 50 for cooling the DREX LRU.

Figure 9:
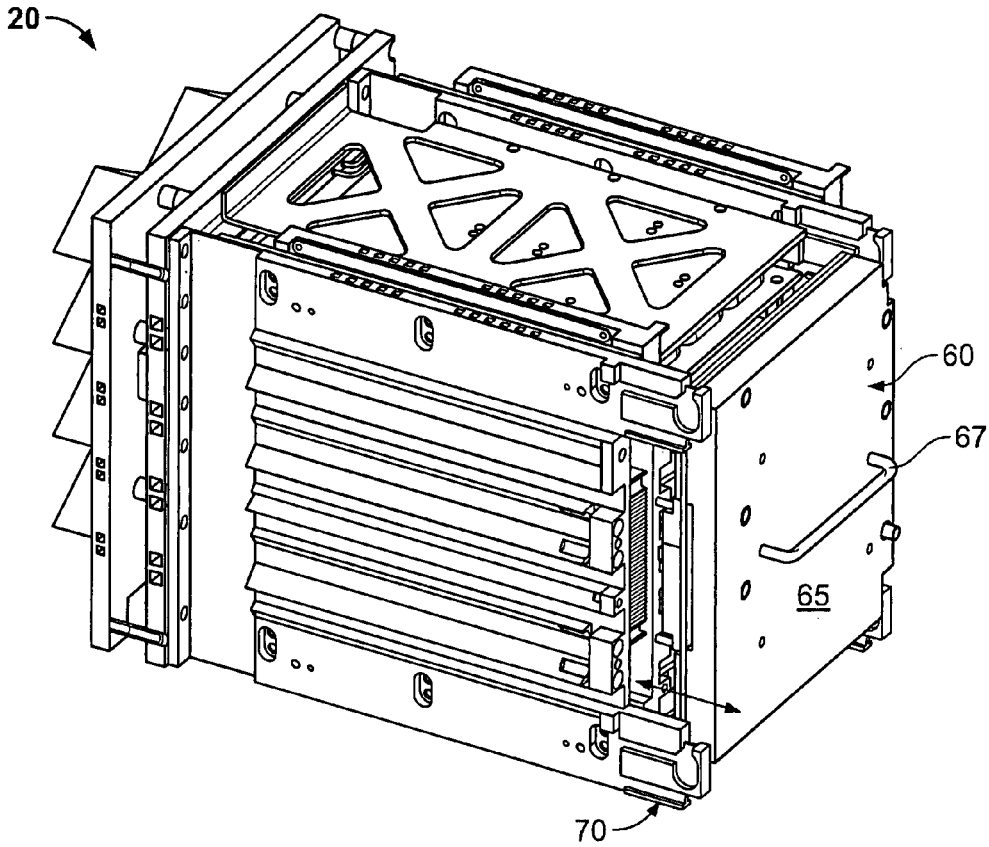
FIG. 9 is a perspective view of the module of FIG. 2 with the rear cover LRU in a closed position.
Figure 10:
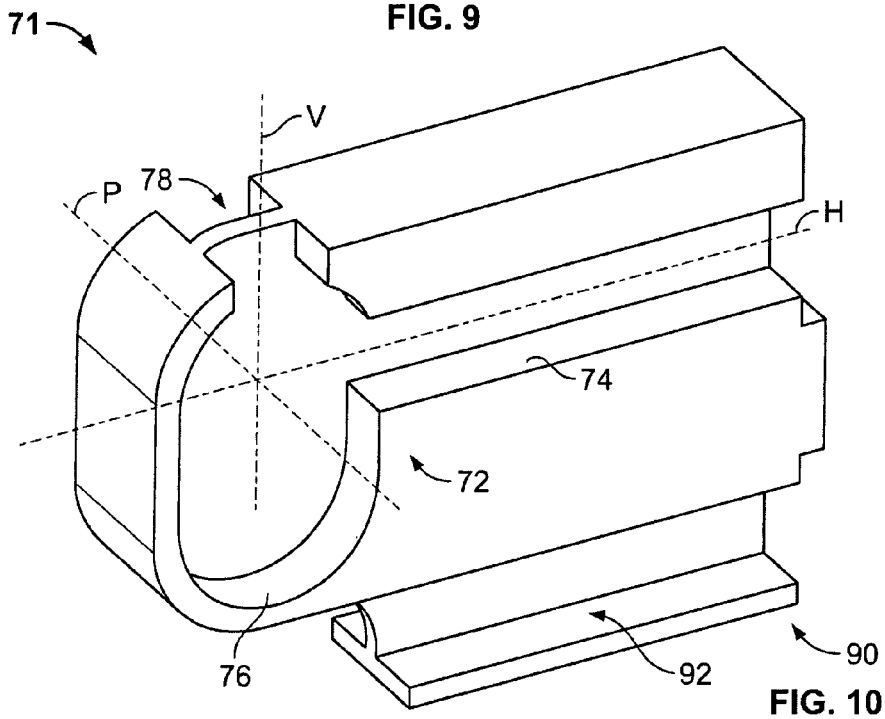
FIG. 10 is a perspective view of a hinge protrusion of the hinge of FIG. 3.

A preferred method of operating hinge 70 will now be described, beginning with the removal step from an already assembly antenna array. Accordingly, as shown in FIG. 9, module 20 is depicted in the starting closed position with DREX LRU 60 in a vertical position and fully attached to back end 14 of the module. With additional reference to FIGS. 5-8 that show movements of a bottom hinge tab 80 in recess 72, fasteners 64 are first unscrewed to release DREX LRU 60 from module 20. DREX LRU 60 is then slid straight back away from module 20 with hinge tabs 80 riding horizontally in connector engagement slots 74, thereby smoothly disengaging and breaking the electrical interface connections described herein without undue twisting (see FIG. 6). This prevents damage to the electrical connectors, and especially bending of any pin connectors that may be incorporated therewith. Top guide tab 82 similarly travels rearward horizontally in channel 92 (not shown).

Figure 5:
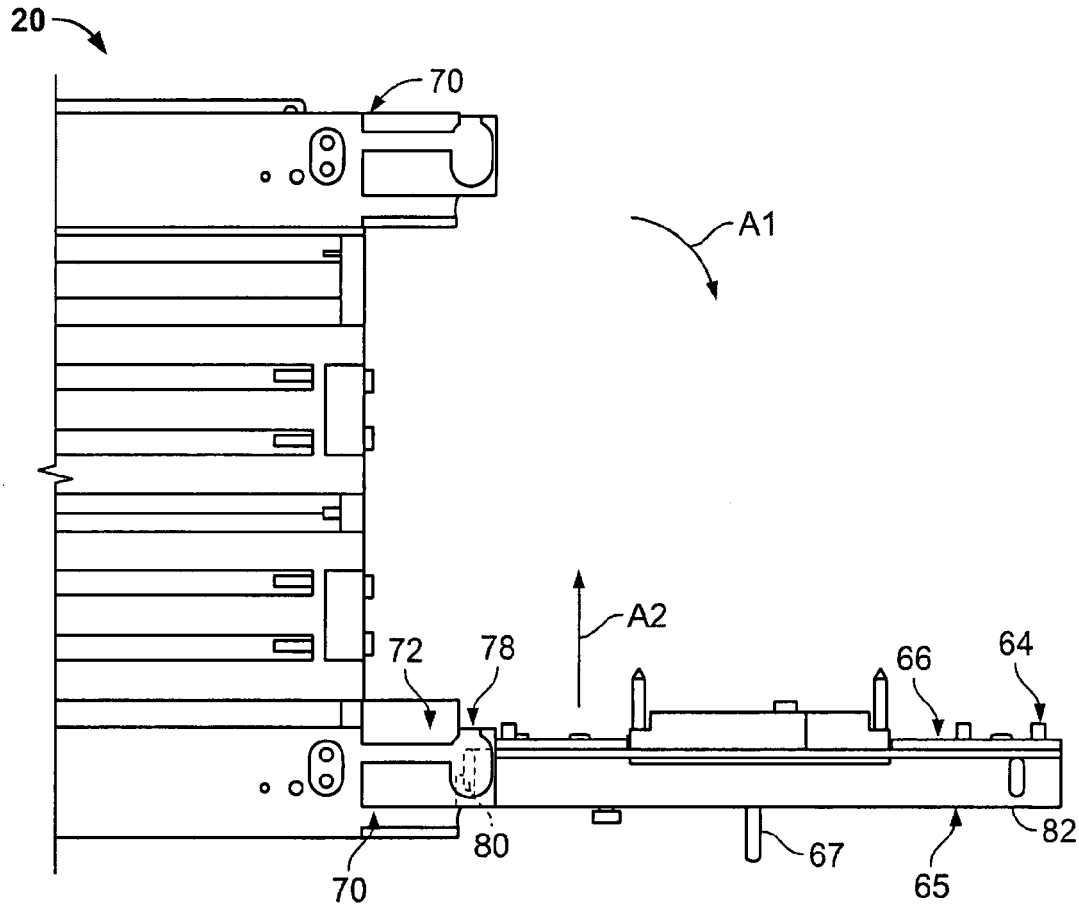
FIG. 5 is a side elevation view of the module of FIG. 2 with the rear cover LRU shown in an open position.
Figure 6:
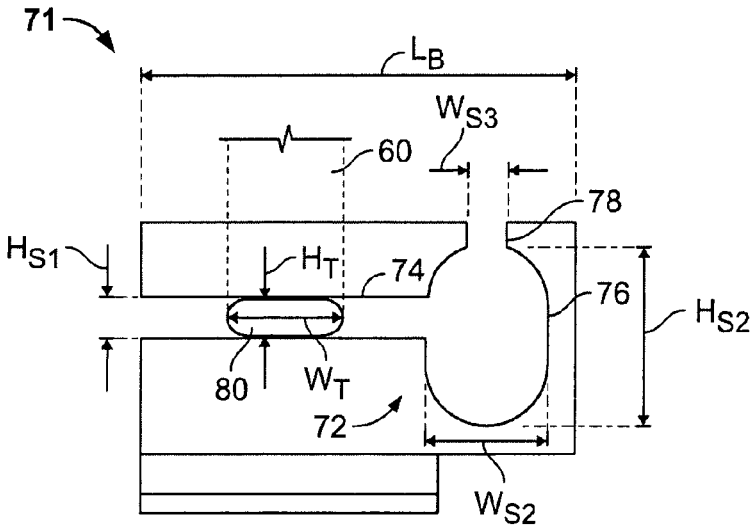
FIGS. 6-8 are detailed side views of the hinge of FIG. 3 with the rear cover LRU shown in various positions.

DREX LRU 60 continues travel rearwards through a predetermined distance until tabs 80 emerge from slots 74 and enter enlarged receptacles 76 (see FIG. 7), and top guide tab 82 emerges from channel 92 (not shown). As best shown in one embodiment in FIG. 10, channel 92 is preferably shorter in horizontal length than recess 72 so that the top of DREX LRU 60 may be pivoted backwards and downwards from its vertical position (see FIG. 5, directional arrow $A_1$). Enlarged receptacles 76 allow bottom hinge tabs 80 to be fully rotated therein to accommodate the pivoting movement of DREX LRU 60. Interior space 28 of module 20 is now fully exposed allowing access to the LRUs inside for maintenance or inspection. If DREX LRU 60 is intended to be fully removed, DREX LRU is rotated and pivoted 90 degrees downwards from vertical to the horizontal position shown in FIG. 5. Tabs 80 become vertically positioned in receptacles 76 and aligned with removal slot 78. DREX LRU 60 may then be lifted upwards to completely remove the DREX LRU from module 20, as shown in FIGS. 5 (directional arrow A2) and 8. Optionally, if DREX LRU 60 is intended to remain attached to module 20 during maintenance of the other LRUs, the DREX LRU is pivoted downwards 180 degrees from its initial vertical position and allow to hang from hinge 70 in the position shown in FIG. 2. The engagement of tabs 80 with receptacles 76 allow DREX LRU 60 to dangle from module 20 if desired so that the LRU is less likely to be damaged or misplaced.

DREX LRU 60 may be reinstalled by essentially reversing the steps described above.

It will be appreciated that although a rear access cover in the embodiments shown herein are made of an electrically active component such as DREX LRU 60, a hinge formed according to principles of the present invention may be used with any type or configuration of a non-active cover or access panel that is arranged in any orientation or position. In addition, the invention is not limited to hinge applications for antenna arrays alone. Accordingly, the hinge may be used for mounting any type of hinged object to a supporting unit or frame where a mechanically simple, reliable, and cost-effective hinge is desirable.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A multi-directional hinge comprising:

a first hinge member defining at least one first outwardly-projecting hinge tab, the tab having a width and a height wherein the width is greater than the height, the first hinge member further defining a second hinge tab laterally spaced apart from the first hinge tab, the second hinge tab having a width and a height wherein the width is greater than the height;

a second hinge member having a first recess receiving the first hinge tab of the first member, the recess including a slot complimentary configured with the tab to allow non-rotational linear movement of the tab in the slot and an enlarged receptacle complimentary configured with the tab to allow rotational movement of the tab in the receptacle; and a third hinge member having a second recess receiving the second hinge tab and being laterally spaced apart from the first recess, the second recess including a slot complimentary configured with the second hinge tab to allow non-rotational linear movement of the second tab in the slot and an enlarged receptacle complimentary configured with the second tab to allow rotational movement of the second tab in the receptacle, wherein the first hinge tab is movable from a first position in the slot where the tab cannot be rotated to a second position in the receptacle where the tab can be rotated, and wherein the first hinge member includes a guide tab spaced-vertically apart from the first and second hinge tabs, the guide tab received in a channel disposed on a frame supporting the second and third hinge members.

2. The hinge of claim 1, wherein the second hinge member is a bracket supported by and projecting outwards from a frame.

3. A multi-directional hinge comprising:

a first hinge member defining at least one first outwardly-projecting hinge tab, the tab having a width and a height wherein the width is greater than the height; and a second hinge member having a first recess receiving the first hinge tab of the first member, the recess including a slot complimentary configured with the tab to allow non-rotational linear movement of the tab in the slot and an enlarged receptacle complimentary configured with the tab to allow rotational movement of the tab in the receptacle, wherein the first hinge tab is movable from a first position in the slot where the tab cannot be rotated to a second position in the receptacle where the tab can be rotated, and wherein the first hinge member includes a guide tab spaced-vertically apart from the first hinge tab, the guide tab received in a channel disposed on a frame supporting the second hinge member.

4. The hinge of claim 3, wherein the first hinge member is a movable equipment access cover.

5. The hinge of claim 4, wherein the access cover is an electrically active electronic component have at least one electrical connection.

6. A multi-directional hinge comprising:

a unit including a pair of laterally spaced apart elongated hinge tabs, each tab projecting outwards from the unit and having a width larger than a height; and a frame supporting the unit and including a pair of spaced-apart brackets each having a recess receiving one of the hinge tabs respectively therein, each recess comprising an elongated horizontal slot configured for non-rotational linear movement of the respective tab therein, a vertical slot, and an enlarged receptacle formed at an intersection of the horizontal and vertical slots, the receptacle sized and configured with the respective tab to allow rotational movement of the tab therein;

wherein the unit is pivotally moveable with respect to the frame via rotation of the hinge tabs in the receptacles.

7. The hinge of claim 6, further comprising a guide tab spaced-vertically apart from the first and second hinge tabs on the unit, the guide tab received in a channel disposed on the frame.

8. The hinge of claim 7, wherein the guide tab has an elongated shape.

9. The hinge of claim 7, wherein the channel is disposed on a third bracket disposed on the frame.

10. The hinge of claim 9, wherein the third bracket includes a recess receiving a third hinge tab from a second unit, the recess comprising an elongated horizontal slot configured for non-rotational linear movement of the third hinge tab therein, a vertical slot, and an enlarged receptacle formed at an intersection of the horizontal and vertical slots, the receptacle sized and configured with the third hinge tab to allow rotational movement of the third tab therein.

11. The hinge of claim 6, wherein the unit is electrically active and includes at least one electrical connection.

12. The hinge of claim 11, wherein the unit is a line replaceable unit of an antenna array.

13. A multi-directional hinge comprising:

a unit including a pair of laterally spaced apart elongated hinge tabs, each tab projecting outwards from the unit and having a width larger than a height;

a frame supporting the unit and including a pair of spaced-apart brackets each having a recess receiving one of the hinge tabs respectively therein, each recess comprising an elongated horizontal slot configured for non-rotational linear movement of the respective hinge tab therein, a tab removal slot, and an enlarged receptacle formed at an intersection of the horizontal and removal slots, the receptacle sized and configured with the respective tab to allow rotational movement of the tab therein; and a guide tab spaced-vertically apart from the first and second hinge tabs on the unit, the guide tab received in a channel disposed on the frame;

wherein the unit is pivotally moveable with respect to the frame via rotation of the tab in the receptacle and removable from the frame via the removal slot.

14. The hinge of claim 13, wherein the horizontal slot is located between the receptacle and frame.

15. The hinge of claim 13, wherein each bracket includes a channel configured to receive a guide tab from an adjoining unit.

* * * * *